US006700918B2

(12) United States Patent
Heras Cuenca

(10) Patent No.: US 6,700,918 B2
(45) Date of Patent: Mar. 2, 2004

(54) ELECTRIC FURNACE FOR THE PRODUCTION OF METAL OXIDES

(75) Inventor: Francisco Heras Cuenca, Barcelona (ES)

(73) Assignee: Coplosa, S.A., Barcleona (ES)

( * ) Notice: Subject to any disclaimer, the term of this patent is extended or adjusted under 35 U.S.C. 154(b) by 0 days.

(21) Appl. No.: 10/054,072

(22) Filed: Nov. 13, 2001

(65) Prior Publication Data

US 2002/0064204 A1 May 30, 2002

(30) Foreign Application Priority Data

Nov. 28, 2000 (ES) ..... 200002840

(51) Int. Cl.[7] ..... H05B 3/00; F27D 3/00

(52) U.S. Cl. ..... 373/109; 373/115

(58) Field of Search ..... 373/109, 111, 373/115, 122, 123, 78, 82; 266/199; 414/167–170, 195, 200–206; 198/467.1, 458, 545; 74/10.85; 219/200

(56) References Cited

U.S. PATENT DOCUMENTS

| | | | | |
|---|---|---|---|---|
| 4,352,969 A | | 10/1982 | Wulf | |
| 4,606,283 A | | 8/1986 | DesOrmeaux et al. | |
| 4,631,026 A | | 12/1986 | McKinney | |
| 4,912,301 A | | 3/1990 | McKinney et al. | 219/388 |
| 5,579,334 A | * | 11/1996 | Baxter et al. | 373/109 |

FOREIGN PATENT DOCUMENTS

| | | |
|---|---|---|
| EP | 0 365 260 A2 | 4/1990 |
| EP | 0 406 954 A1 | 1/1991 |
| ES | 8405134 A1 | 9/1984 |

* cited by examiner

*Primary Examiner*—Tu Ba Hoang
(74) *Attorney, Agent, or Firm*—Darby & Darby

(57) ABSTRACT

The furnace comprises a tubular inner chamber for the treatment of the raw material, mounted inside the enveloping body of the furnace which is insulated from the exterior and is provided with internal resistor systems for heating the chamber of the furnace by radiation, comprising means for feeding raw material at one end and means for controlling the output of completed product at the other end of the treatment chamber of the furnace, inside which a worm screw, driven in rotation from the exterior, is mounted rotatably, respective percussion devices being incorporated in the ends of the screw to prevent compaction of the mass on the screw.

7 Claims, 7 Drawing Sheets

ELECTRIC FURNACE FOR THE PRODUCTION OF METAL OXIDES

BACKGROUND OF THE INVENTION

The present invention relates to an electric furnace for the production of metal oxides and, in particular, to the production of lead oxides with high standards of quality of the product and of the process, affording considerable advantages over the prior art.

SUMMARY OF THE INVENTION

The main objects of the present invention are to achieve a high quality of the final product and great flexibility with regard to the quality of the raw material, combined with easy management of the furnace, with a reliable and precise control system, and with a reduction in problems in the working environment and in the environment outside the plant. Moreover, according to the present invention, it is possible to achieve considerable advantages over currently known furnaces, such as: low investment and installation cost, low energy cost per ton of product produced, low maintenance cost, much quicker start-up, and a reduction in residues produced during start-up.

To achieve its objects, the present invention provides for a tubular furnace with a tubular treatment chamber made of stainless refractory steel (AISI-310) and provided with a plurality of heating zones with individual control probes, in particular, three heating zones, each of which comprises six resistors connected so as to achieve a balance in electrical consumption between phases, each heating zone having its optimal adjustment point in dependence on the quality of the raw material, on its physical and chemical characteristics, and on the physical and chemical characteristics of the finished product to be produced.

The electrical control panel comprises controllers of consumption per phase and of voltage between phases, and can warn of any electrical problem with the resistors.

The heating control system permits adjustment of the electrical consumption of the furnace at any moment in dependence on the state of the furnace, as well as the use of full power during start-up and, during the normal process, consumption controlled by the temperatures of the chamber.

The construction of the furnace enables great functional flexibility to be achieved therein in order to adapt to the quality of the raw material used, for which purpose energy consumption is adjusted according to the quality of the raw material.

The raw material introduced into the tubular chamber is urged by an agitator shaft towards the end of the furnace body at which the finished product is discharged by a rotary valve. The agitator shaft rotates by virtue of the driving action of a geared motor unit controlled by a frequency meter from the control panel of the furnace. The agitator shaft is of mixed construction, with the use of AISI-310 stainless steel in the portion which is in contact with the product and AISI-304 for the rest. It is constituted by a central tubular element with a square cross-section, constituted by welded plates and a set of vanes welded to the central tube on its respective faces and arranged in a manner such as together to constitute a helical screw. One of the characteristics of the agitator shaft of the furnace of the present invention is that it has, in its outer portions, percussion devices or "hammers" with balls inside them which, by virtue of the rotation of the agitator shaft, cause impacts and vibration inside the shaft, preventing the product from adhering to the shaft.

The quality of the final product is adjusted by control of the time spent by the product inside the furnace and also by the output or final production flow, for which purpose the present invention provides for a frequency variator which controls the rate of rotation of the agitator shaft and also the rate of rotation of the helical screw which feeds raw material to the furnace. According to the invention it will also be possible to install two separate speed variators, one for the agitator shaft and the other for the worm screw for feeding the raw material to the furnace itself. The furnace as a whole is thermally insulated by refractory bricks with a temperature classification of up to 1,260° C., the bricks additionally providing the necessary support for the electrical resistors. The insulation is completed by high-density ceramic fibre (128 kg/m$^3$) with a temperature classification of up to 1,260° C.

To compensate for the large expansions brought about in the tubular element of the furnace, according to the present invention, movable elements are provided which allow the tube to lengthen freely. In particular, a free extension system is provided, which takes up the expansions of the tubular chamber and of the displacement screw resulting from the temperature difference produced inside the heating chamber.

The furnace is controlled by a centralized panel which comprises the elements necessary for the control of temperature in the chamber of the furnace and alarm elements for providing warnings when the values of the control parameters depart from the range of values provided for during the production process.

BRIEF DESCRIPTION OF THE DRAWINGS

For a better understanding, some drawings of a preferred embodiment of the furnace of the present invention are appended by way of non-limiting example.

DESCRIPTION OF THE INVENTION

Figure 1:
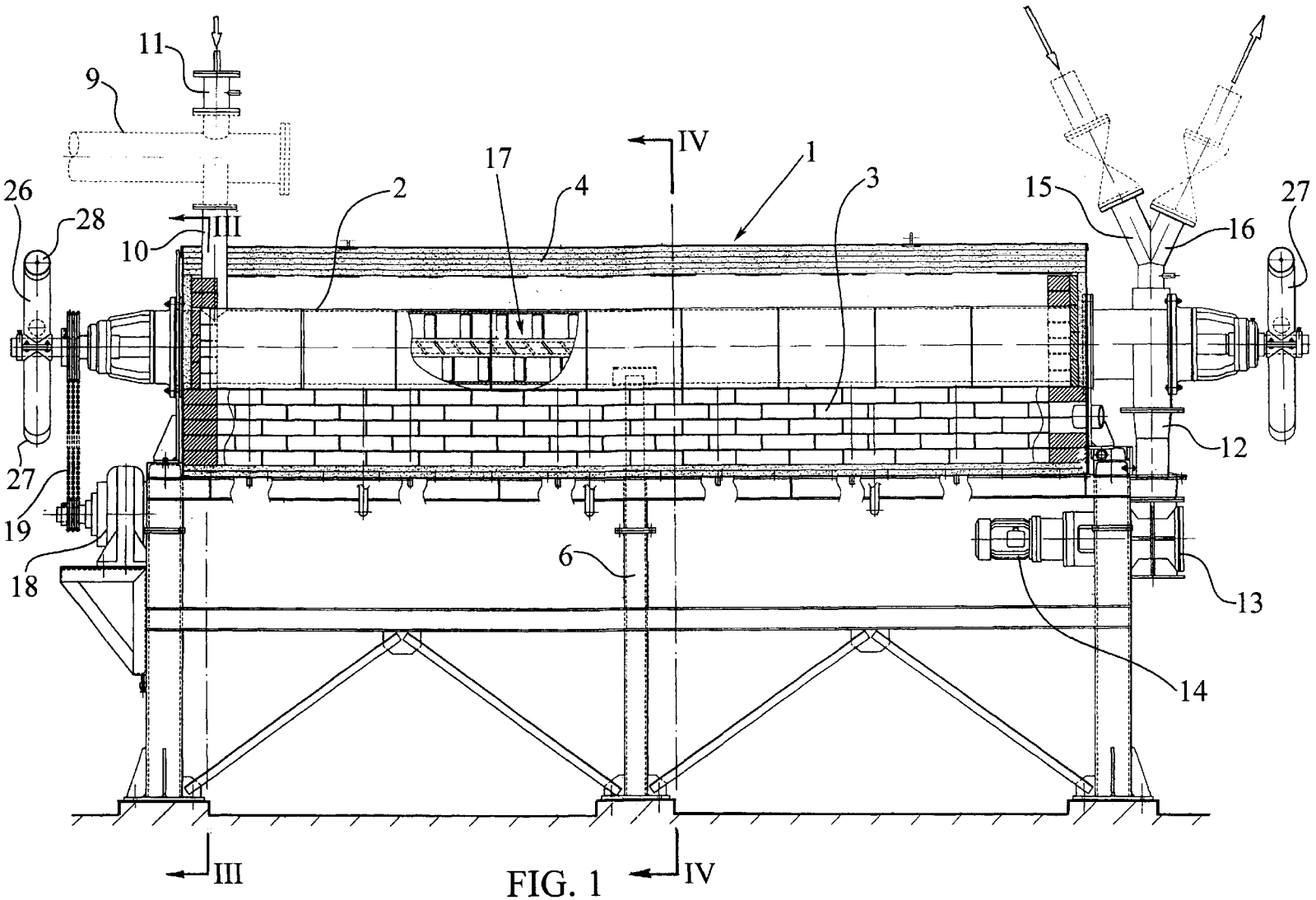
FIG. 1 is a partially-sectioned, side elevational view of the furnace of the present invention.

According to the embodiment shown in the drawings, the furnace of the present invention comprises a main body 1 of tubular structure, of which the central element is constituted by the tubular chamber 2 of the furnace mounted in the furnace body, which is insulated by means of refractory bricks 3 and insulation layers based on high-density ceramic fibre, indicated in the upper portion by the numeral 4.

Figure 4:
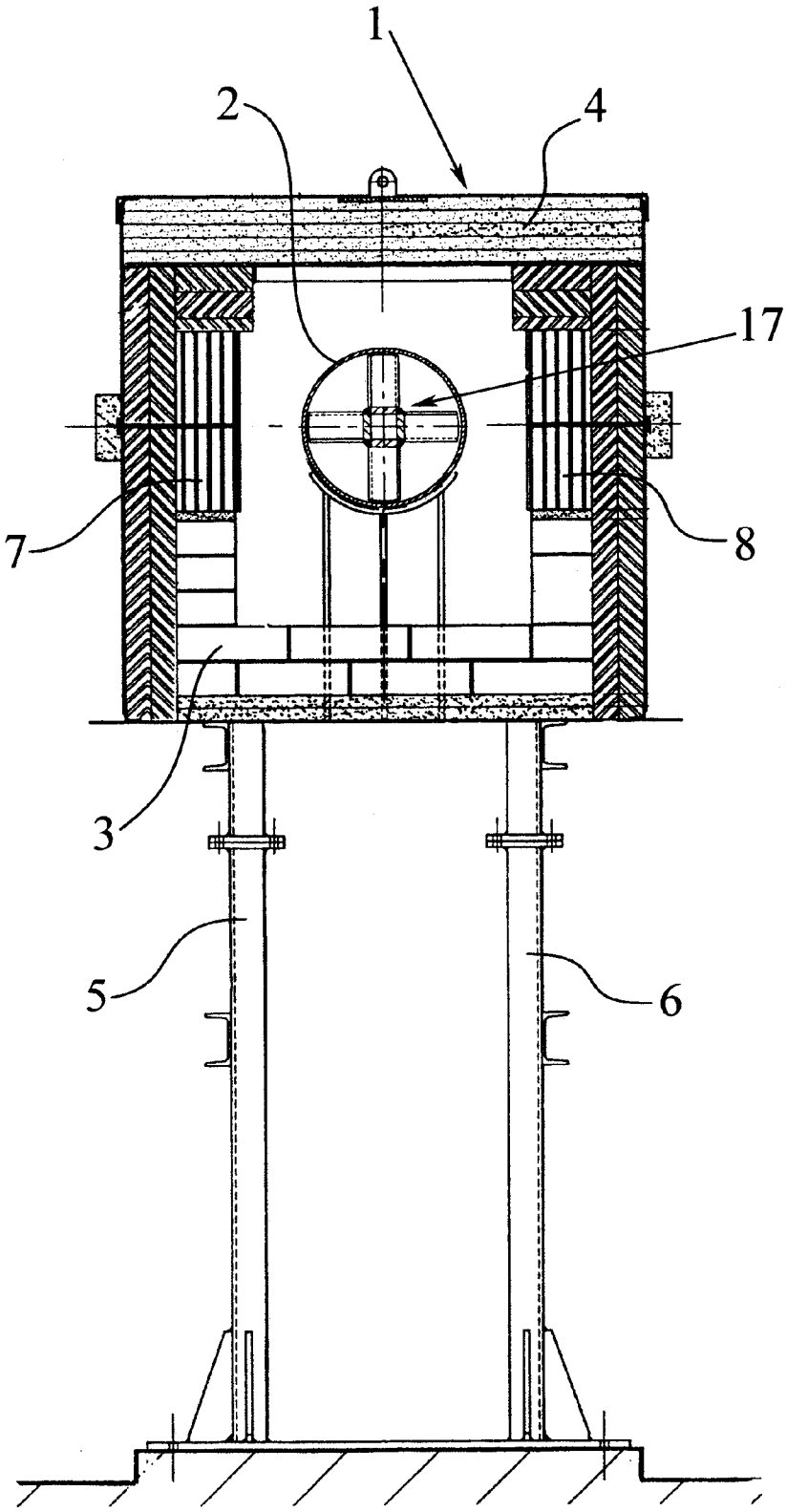
FIG. 4 show, in cross-section, a detail of the mounting of the heating resistors.
Figure 5:
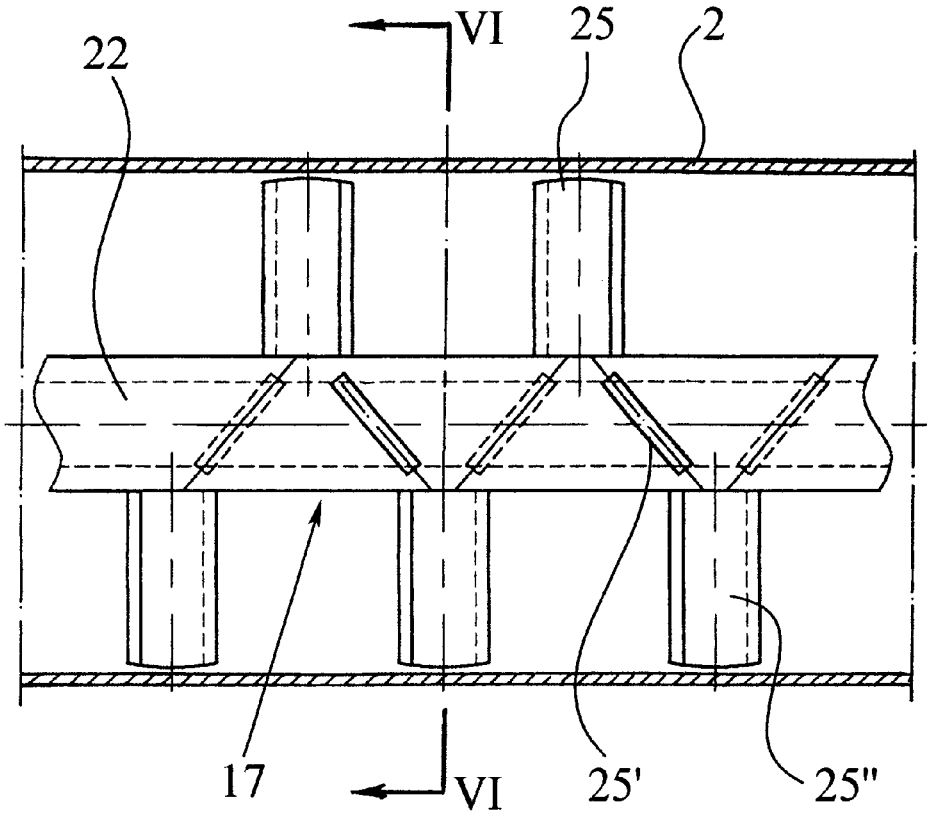
FIGS. 5 and 6 show respective details of the main screw of the furnace.

The furnace is heated by radiation, by panels of electrical resistors incorporated in the body of the furnace, as can be seen in the detail of FIG. 4 in which the furnace body 1 is mounted on a support frame composed principally of a variable number of upright posts 5 and 6 for fixing the furnace to the floor, in the interior, it is possible to see the mounting of the lateral panels of heating resistors 7 and 8 which are incorporated in the insulating refractory material composed of the refractory bricks 3 having a temperature classification of up to 1,260° C. A plurality of heating zones, preferably three zones, are disposed along the furnace, each zone having six resistors distributed longitudinally.

Each of the three heating zones will be provided with two K-type temperature probes for the control of the heating resistors.

Each of the heating zones can utilize its optimal adjustment point in dependence on the quality of the raw material, on the physical and chemical characteristics thereof, and on the physical and chemical characteristics of the final product to be produced.

The input of raw material will take place through a feed pipe 9, shown in broken outline, provided with an helical screw for forcing the material to enter the chamber 2 through the duct 10. There is a simultaneous intake of air 11. The output of the product, after it has been treated as it travels along the tubular chamber 2, will take place at the opposite end through a gravity outlet 12, into a rotary collector 13 driven by an independent geared motor unit 14. At the actual outlet of the furnace chamber, there will be an air-inlet 15 and optional air extraction 16, both being controlled by corresponding valves.

The raw material is moved along the main chamber 2 of the furnace by an internal screw of special construction, indicated 17 in FIGS. 1 and 5 to 11. The screw is rotated by a geared motor unit 18 and a transmission system 19 with belts, chains, or the like.

Figure 6:
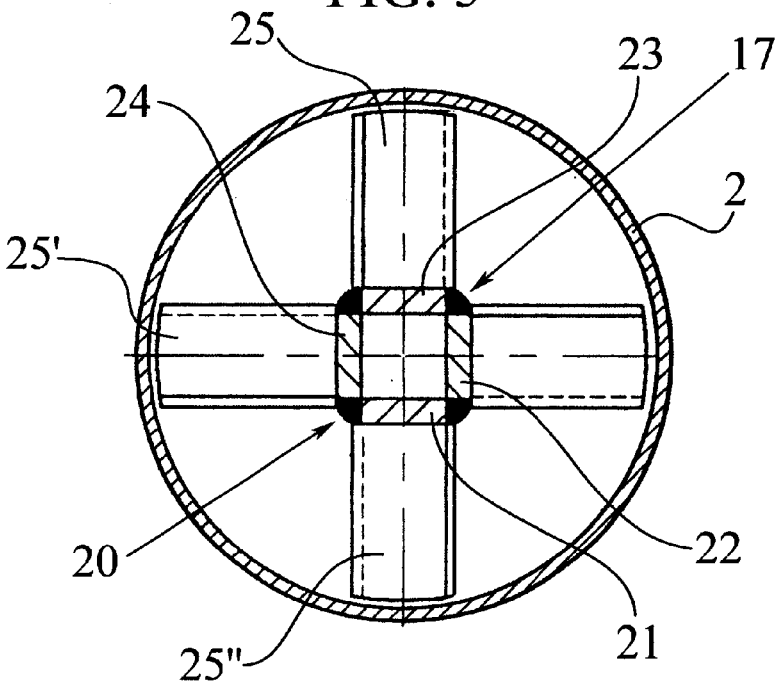
Figure 7:
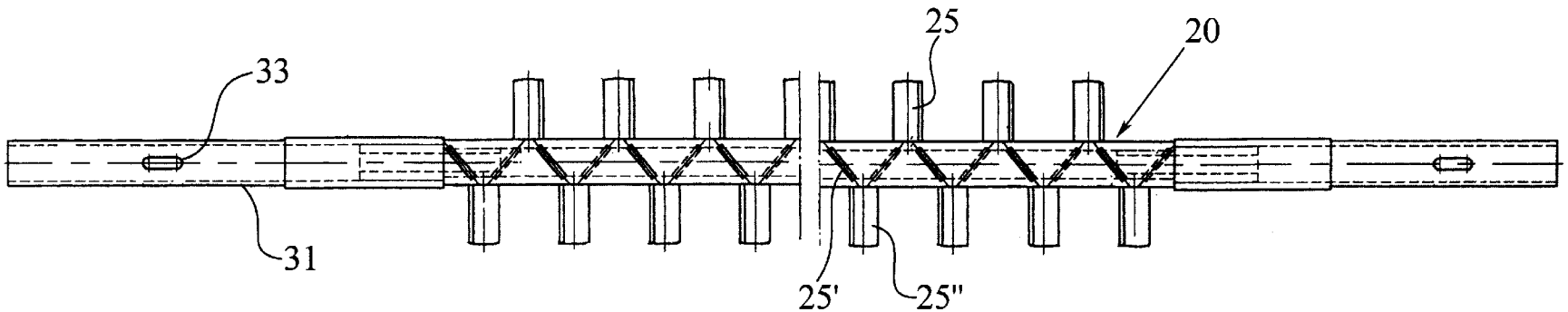
FIG. 7 is a schematic side elevational view of the entire main screw.

The screw 17 is constituted by a square, tubular central element, as can be seen in FIG. 6, in which it is possible to see the screw 17, which is constituted by a square central tubular element 20 with faces 21, 22, 23 and 24 on which sets of aligned vanes 25, 25', -25" . . . are fixed, the vanes being arranged at suitable inclinations so as together to form a helical screw for moving the raw material along the tubular chamber of the furnace.

Figure 2:
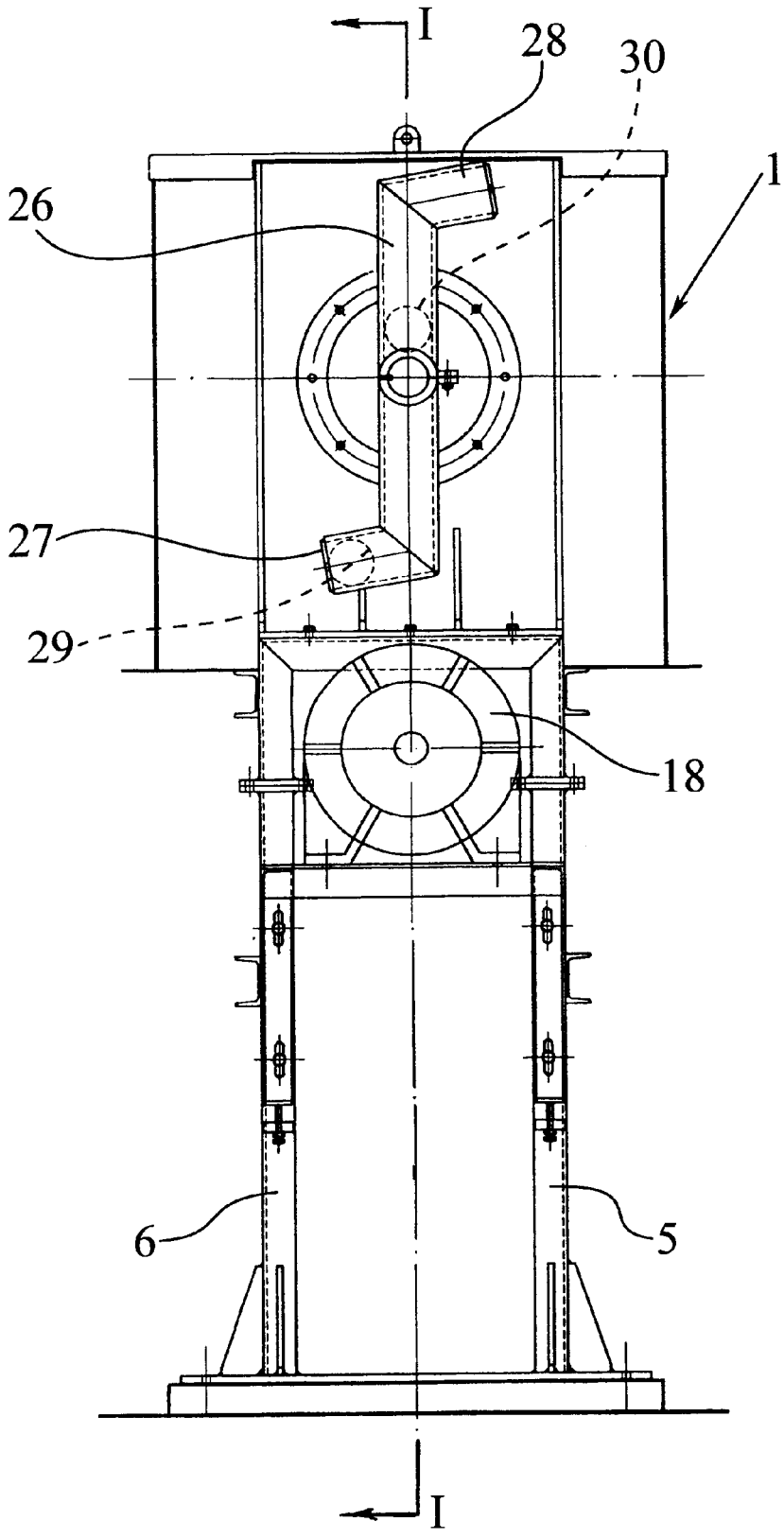
FIG. 2 is an elevational view taken from one end of the furnace.
Figure 3:
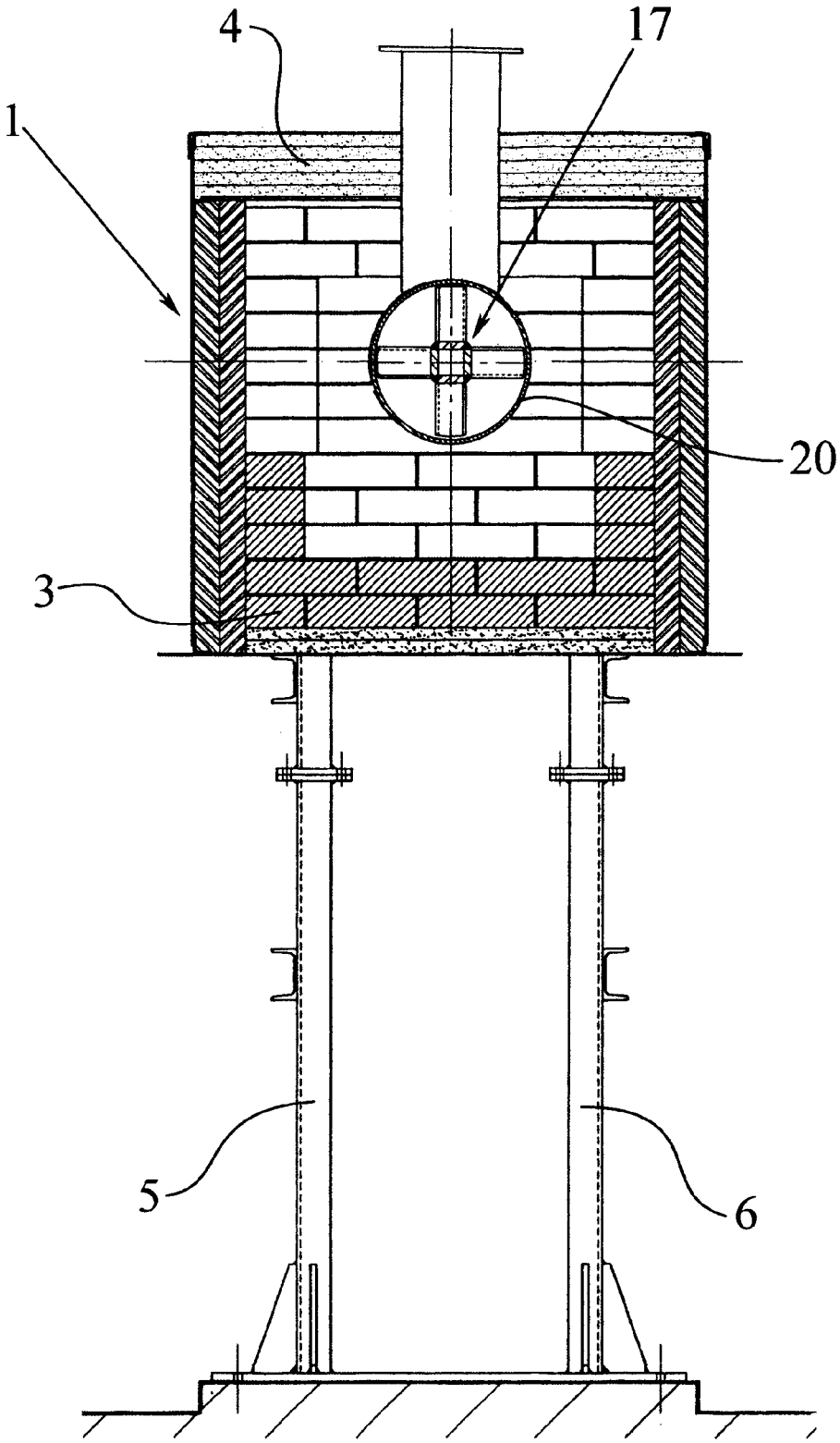
FIG. 3 shows a detail in a section taken in the section plane indicated.

Respective percussion devices or "hammers", indicated 26 and 27 in FIG. 1, are incorporated in the ends of the agitator shaft 17. Each of these elements is constituted by a central tubular body, FIG. 2, and respective short end extensions 27 and 28 of predetermined inclination, there being disposed inside the elements, some free masses such as spheres 29 and 30, which can be moved along the tubular elements upon rotation of the screw, giving rise to impacts which prevent adhesion or compaction of the material on the screw.

Figure 8:
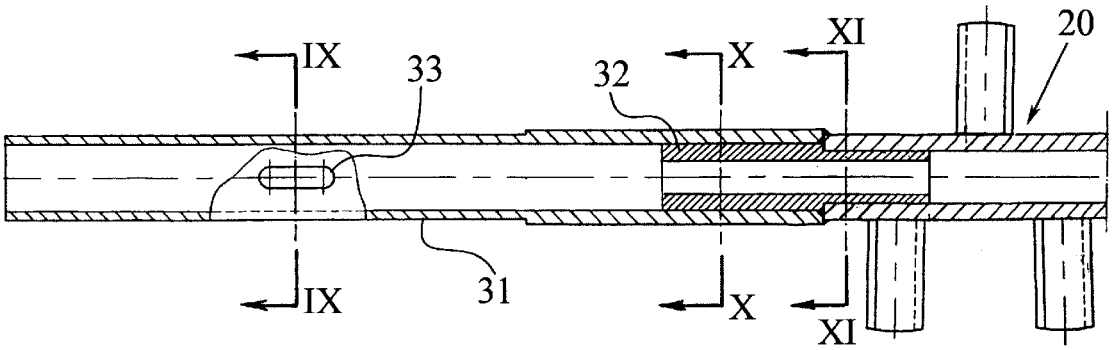
FIG. 8 shows a detail of one end of the main screw.
Figure 9:
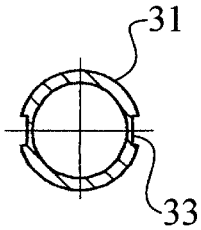
FIGS. 9, 10 and 11 show respective details of the furnace in cross-sections taken in the section planes indicated.
Figure 10:
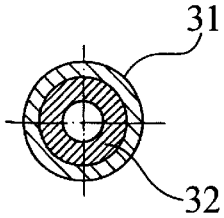
Figure 11:
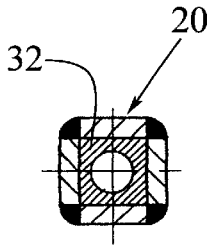

The central tubular element 20 forming the drive screw has ends to which the drive and percussion members can be coupled by keying as can be seen in FIG. 8 and the following drawings. As can be seen, a tubular extension 31 is coupled to the square tubular element 20 by means of an internal coupling sleeve 32 which is coupled with the two tubular elements enabling the end 21 to have openings 33 of suitable shape and arrangement for the coupling of the drive members of the furnace.

What is claimed is:

1. An electrical furnace for the production of metal oxides comprising a tubular inner treatment chamber for treatment of a raw material, mounted inside an enveloping body of the furnace and insulated from said enveloping body, wherein said inner treatment chamber is provided with internal resistor systems for heating said inner treatment chamber of the furnace by radiation, means for feeding raw material at one end of the treatment chamber and means for controlling output of completed product at another other end of the treatment chamber, helical screw is mounted rotatable inside said treatment chamber and driven in rotation from the exterior of said treatment chamber, and respective percussion devices are incorporated at ends of said helical screw to prevent compaction of the raw material and the completed product on said helical screw, wherein each of percussion devices mounted at ends of a shaft of the helical screw for moving the raw material being treated is formed by a transverse tubular element in a symmetrical arrangement with respect to the axis of the helical screw and provided with shorter closed ends of predetermined inclination, inside which there are freely movable masses which can produce impacts during rotation of the screw, preventing compaction of the raw material being treated.

2. An electrical furnace for the production of metal oxides comprising a tubular inner treatment chamber for treatment of a raw material mounted inside an enveloping body of the furnace and insulated from said enveloping body, wherein said inner treatment chamber is provided with internal resistor systems for heating said inner treatment chamber of the furnace by radiation, means for feeding raw material at one end of the treatment chamber and means for controlling output of completed product at another other end of the treatment chamber, a helical screw is mounted rotatable inside said treatment chamber and driven in rotation from the exterior of said treatment chamber, and respective percussion devices are incorporated at ends of said helical screw to prevent compaction of the raw material and the completed product on said helical screw wherein the helical screw for moving the raw material is composed of a central body, the outer surface of which is fixed sets of aligned vanes, arranged at an inclination so as together to form a helical screw for moving the raw material to be treated, and wherein the central body of the screw is formed by square prismatic shaped plates welded together forming its faces.

3. The electrical furnace for the production of metal oxides according to claim 1, wherein said internal resistor systems are disposed in respective sets in alignment on side walls of the enveloping body of the furnace, on opposite sides of the tubular inner treatment chamber, and divided into a plurality of independently controlled longitudinal sections, permitting independent temperature adjustment points for adapting the furnace to different characteristics of the raw material and of the product to be produced.

4. The electrical furnace for the production of metal oxides according to claim 1, wherein the enveloping body of the furnace comprises insulating refractory masonry which also houses said internal resistor systems, and an insulation of high-density ceramic fibres is completed on top of said enveloping body.

5. The electrical furnace for the production of metal oxides according to claim 1, wherein, at an input end of the furnace there is a worm-screw feeder for input of the raw material, also provided with an air inlet and, at an end for the output of the raw material, there is a gravity outlet and a rotary collector, and a respective air inlet and air outlet, controlled by respective valves.

6. The electrical furnace for the production of metal oxides according to claim 1, wherein the helical screw of the treatment chamber is driven in rotation by means of a frequency variator which simultaneously controls a speed of rotation of a worm screw of tubular raw-material feeder element for said treatment chamber.

7. The electrical furnace for the production of metal oxides according to claim 1, wherein the furnace has a free extension system which takes up expansions of the treatment chamber and of the helical screw resulting from a difference in temperatures produced inside the treatment chamber.

* * * * *